United States Patent [19]

Noguchi et al.

[11] Patent Number: 4,794,875

[45] Date of Patent: Jan. 3, 1989

[54] SEWING MACHINE APPARATUS FOR SETTING THE PITCH OF THE LAST ADDITIONAL STITCH

[75] Inventors: Minetoshi Noguchi; Somio Goto; Masakazu Nemoto; Jiro Ishibashi, all of Chofu, Japan

[73] Assignee: Juki Corporation, Tokyo, Japan

[21] Appl. No.: 935,175

[22] Filed: Nov. 26, 1986

[30] Foreign Application Priority Data

Nov. 29, 1985 [JP] Japan ..... 60-269991

[51] Int. Cl.[4] ..... D05B 27/22; D05B 69/22

[52] U.S. Cl. ..... 112/315; 112/275; 112/121.11

[58] Field of Search ..... 112/275, 277, 315, 316, 112/121.11, 2, 262.1, 314

[56] References Cited

U.S. PATENT DOCUMENTS 4,495,877 1/1985 Willenbacher ..... 112/275 X 4,528,923 7/1985 Hager ..... 112/315 X 4,587,915 5/1986 Wenz et al. ..... 112/275

4,602,577 7/1986 Kothe et al. ..... 112/315 X

*Primary Examiner*—Peter Nerbun

*Attorney, Agent, or Firm*—Morgan & Finnegan

[57] ABSTRACT

In a sewing machine equipped with an apparatus to terminate stitching at a predetermined point, the machine normally does not terminate stitching exactly at the desired predetermined point because the elastic nature of the workpiece causes the workpiece to stretch. A last stitch is added beyond the point where stitching terminates by the "step sewing" apparatus of this invention. To perform step sewing, an operator inputs a stitch pitch for step sewing with a digital switch, then pushes a step sewing button. Based on the selected stitch pitch, a CPU reads selected stitch pitch data. The data is used by the CPU to control a stitch pitch setting mechanism. A stitching device then performs a single stitch at the selected stitch pitch. By selecting the proper stitch pitch, the last stitch can terminate at the desired termination point.

3 Claims, 7 Drawing Sheets

SEWING MACHINE APPARATUS FOR SETTING THE PITCH OF THE LAST ADDITIONAL STITCH

BACKGROUND OF THE INVENTION

The invention relates to stitching devices, and more particularly, to a stitching device for terminating stitching at a precise predetermined point.

Using conventional stitching apparatus, a sewing machine normally does not stop precisely at a predetermined position due to stretching of the workpiece. Additionally, in cases where stitching is done with a pre-set number of stitches, a sewing machine may not terminate at a predetermined point because the variance in thickness among workpieces causes the stitch pitch to vary from workpiece to workpiece. Thus, the last stitch normally terminates before the predetermined position is reached. To terminate at the desired position in many systems, an operator controls sewing the last stitch by holding and adjusting the workpiece with one hand and manually directing the needle movement.

As a result, adjusting the stitch pitch to the rest of the stitch line is difficult and the last stitch usually does not terminate at a precise predetermined point. Thus, when accurate stitching is required, a more exact approach to set the last stitch is necessary.

It is therefore an object of this invention is to provide an apparatus for terminating stitching precisely at a predetermined point.

SUMMARY OF THE INVENTION

This and other objects of the invention are met by providing an apparatus including a means for storing stitch pitch data, a means for selecting a stitch pitch, a means for stitching, a switching means to trigger step sewing, and a means for setting the stitching means to stitch at a selected pitch.

After stitching terminates prior to reaching the predetermined point, the operator determines the necessary pitch for setting the last stitch precisely at the predetermined point. This selected stitch pitch is entered using the means for selecting stitch pitch. A CPU uses this data to retrieve stitch pitch data from the storing means and to set the setting means. Once the operator triggers the switching means for sewing, the CPU controls the stitching means to set a single stitch at the selected pitch.

BRIEF DESCRIPTION OF THE DRAWINGS

The invention will be described in greater detail below by way of reference to the following drawings, in which.

DETAILED DESCRIPTION OF THE DRAWINGS

FIG. 1 to FIG. 6 illustrate a preferred embodiment of the invention.

Figure 1:
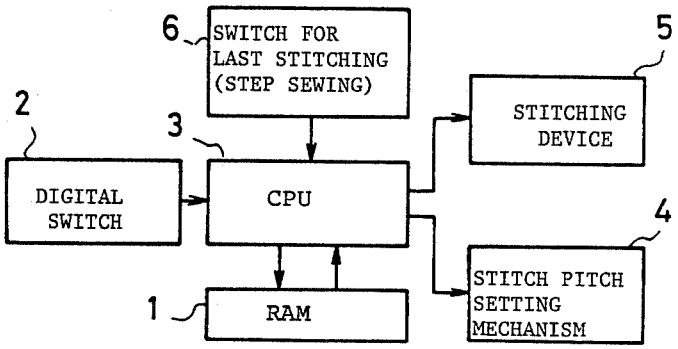
FIG. 1 is a block diagram of one preferred embodiment of the invention.

Referring to FIG. 1, a RAM (random access memory) 1 stores preset stitch pitch data such as shown in TABLE 1 along with the rotational angle of a stepping motor 32 (described below). Digital switch 2 inputs the stitch pitch as a 4 bit value, though other bit resolutions may be used. CPU (central processing unit) 3 reads the stitch pitch data from RAM 1 in compliance with the stitch pitch input at digital switch 2. A stitch pitch setting device 4 sets stitch pitch in compliance with the stitch pitch data read by CPU 3 from RAM 1. A stitching device 5 stitches at the stitch pitch defined by the stitch pitch setting device 4. A switch 6 is provided to command CPU 3 to set stitching device 5 to conduct one-step stitching.

Figure 2:
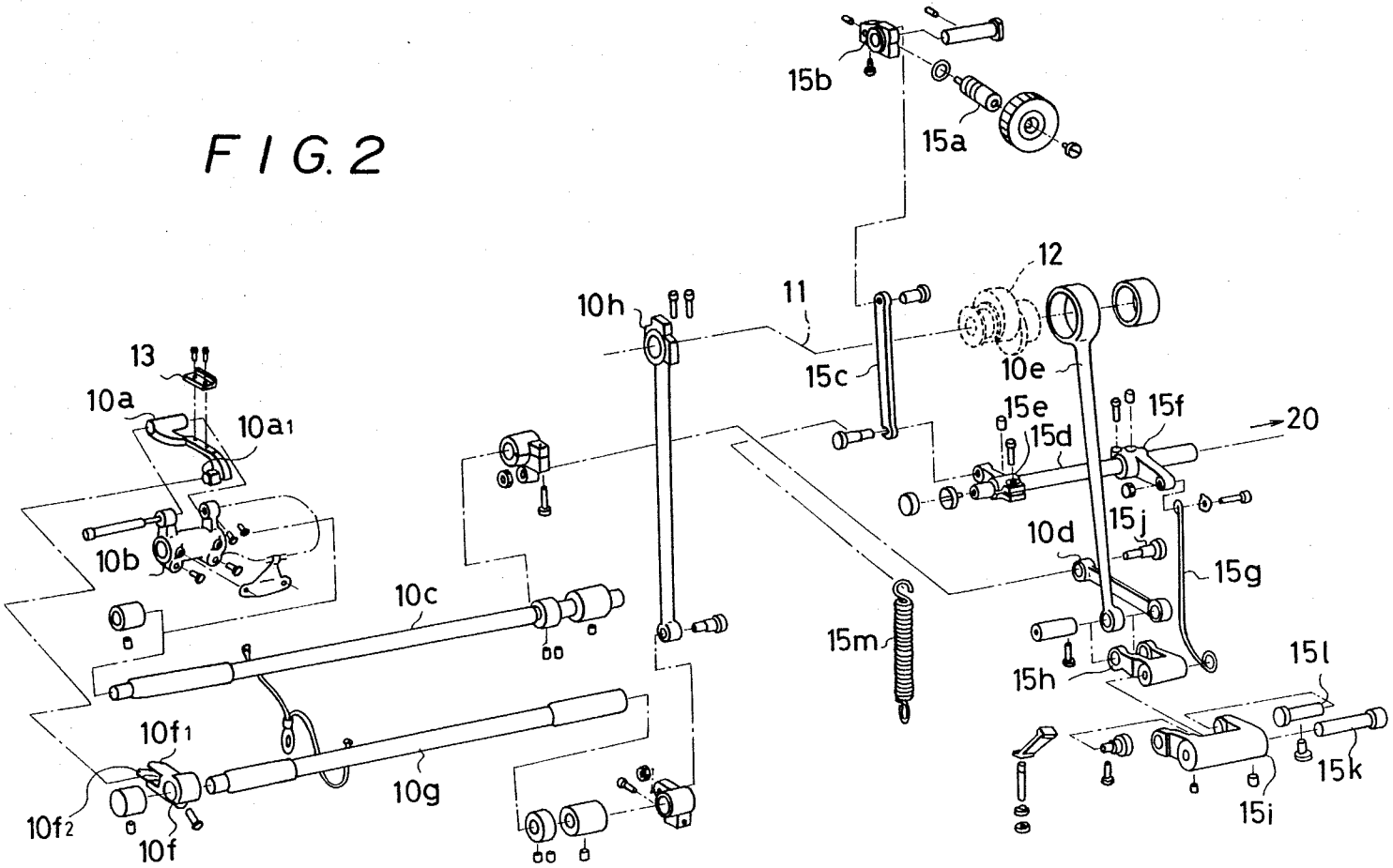
FIG. 2 is a partial and exploded perspective view of a stitch-pitch-adjustinging-mechanism.

Referring to FIG. 2, which shows a stitch-pitch adjusting mechanism for cooperating with stitching device 5 (FIG. 1), a feeding mechanism 10 includes a feed bar 10*a*, a feed rocker 10*b*, a shaft 10*c*, a rod 10*d*, and a connecting rod 10*e*. These parts constitute the horizontal component of the feed dog mechanism. A clamp 10*f*, a shaft 10*g*, and a connecting rod 10*h* constitute the vertical component of the feed dog mechanism.

The horizontal component of the feed dog 13 is actuated by an eccentric cam 12 fixed at a main shaft 11 which causes the connecting rod 10*e* to transmit horizontal movement to the connecting rod 10*d*. This horizontal movement is transmitted to the feed bar 10*a* via the shaft 10*c* and the feed rocker 10*b*, to move the feed dog 13 horizontally.

The vertical component of the feed dog 13 is actuated by the connecting rod 10*h*, in association with the rotation of an eccentric cam 12, and transmits up-down motion to a clamp 10*f* via a shaft 10*g*. A pair of tongues 10*f*1, and 10*f*2 receive a slide block 10*a*1 therebetween to move feed bar 10*a* vertically, and accordingly move the feed dog 13 vertically. Due to the horizontal component motion and the vertical component motion, the feed dog 13 moves with elliptic motion.

FIG. 2 also illustrates a stitch pitch adjusting mechanism 15 comprising an adjusting screw 15*a*, an adjusting cam 15*b*, a rod 15*c*, an adjusting shaft 15*d*, arms 15*e* and 15*f*, a connecting rod 15*g*, a rocker arm 15*h*, a rocker 15*i*, hinge pins 15*j* and 15*k*, a rocker arm pin 15*l*, and a spring 15*m*.

Referring to FIGS. 2 and 3, the adjusting cam 15*b* is urged to rotate counterclockwise by the spring 15*m* via the rod 15*c*. The contact point between the adjusting cam 15*b* and the adjusting screw 15*a* moves as the adjusting screw 15*a* advances or retreats, causing the adjusting shaft 15*d* to rotate via rod 15*c* and arm 15*e*. As a result, rotation is transmitted to the rocker arm 15*h* and the rocker 15*i* via the arm 15*f* and connecting rod 15*g* moving hinge pin 15*k* up and down.

As a result, the position of hinge pin 15*k* changes in relation to a line "L" which connects the center of the hinge pin 15*j* and rocker arm pin 151. Accordingly, the horizontal component of the rocker 15*i*, "$W_1$" in FIG. 3A and "$W_2$" in FIG. 3B, will vary. When reverse feeding is performed, the hinge pin 15*k* is positioned at the lower side of line "L".

Figure 4:
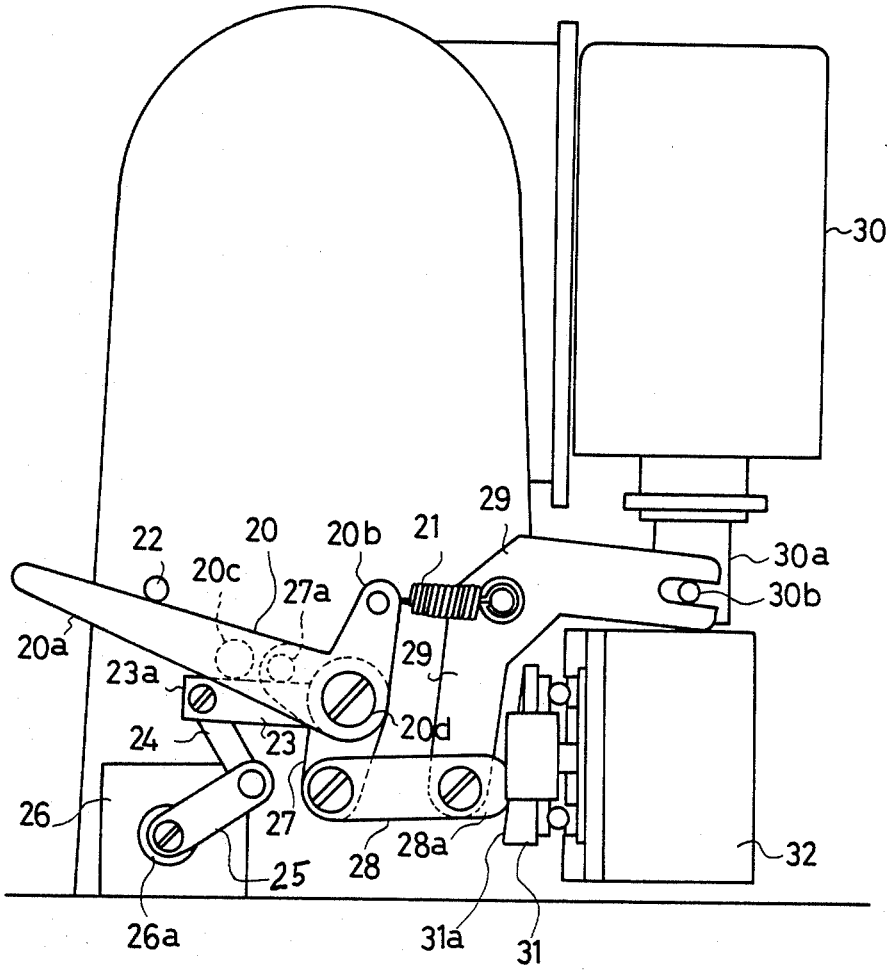
FIG. 4 is a side view of one embodiment of a stitching device.
Figure 5:
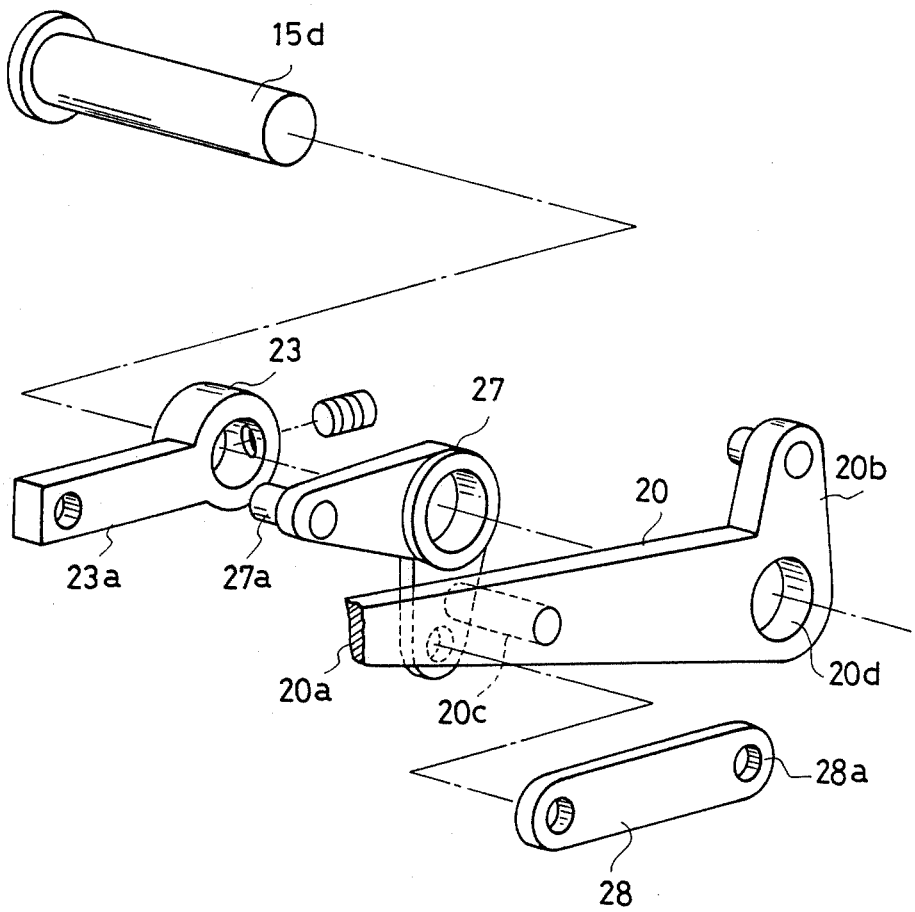
FIG. 5 is a partial and exploded view of the emobodiment of FIG. 4.

Referring to FIG. 4 and FIG. 5 (which illustrate one embodiment of a stitching device for performing the last stitching according to the invention), an "L" shaped reverse feed adjusting lever 20 includes a lever Portion 20*a* and an arm portion 20*b*. An elbow portion 20*d* is pivoted by an adjusting shaft 15*d* protruding from the exterior of the sewing machine of FIG. 4. The lever portion 20*a* is urged to rotate clockwise by a tension spring 21 which connects the arm portion 20*b* and the machine frame. Its rotational motion is limited by a stop pin 22. A rocking arm 23 receives and fixes shaft 15*d* at one end. The other end 23*a* of the rocking arm 23 is connected to a shaft 26*a* of a potentiometer 26 by a link 24 and a link 25.

The upper surface of the rocking arm 23 contacts a stop pin 20*c* at the reverse feed adjusting lever 20. Counter-clockwise rotation of the reverse feed adjusting lever 20 causes the adjusting shaft 15*d* to rotate counterclockwise via the rocking arm 23.

An action lever 27 is shaped like a bell-crank and has an elbow portion pivoted to the adjusting shaft 15*d*. A pin 27*a* provided at one end of the action lever 27 contacts the upper surface of the rocking arm 23.

Another end of the action lever 27 is pivoted to a link arm 28.

A bell crank 29 has a center portion pivoted to the machine frame and one arm pivoted to an end 28*a* of the link arm 28. Another end is bifurcated, clamping a pin 30*b* provided at a plunger 30*a* of a solenoid 30.

A cam body 31 faces the end 28*a* of the link arm 28. The cam body 31 is arranged to enable one-step-rotation of a stepping motor 32 to cause 0.05 mm variation of stitch pitch. In this manner stitch pitch is controlled within 0–2.5 mm. One end 28*a* of the link arm 28 does not touch a surface 31*a* of the cam body 31 unless the solenoid 31 is excited.

Figure 6:
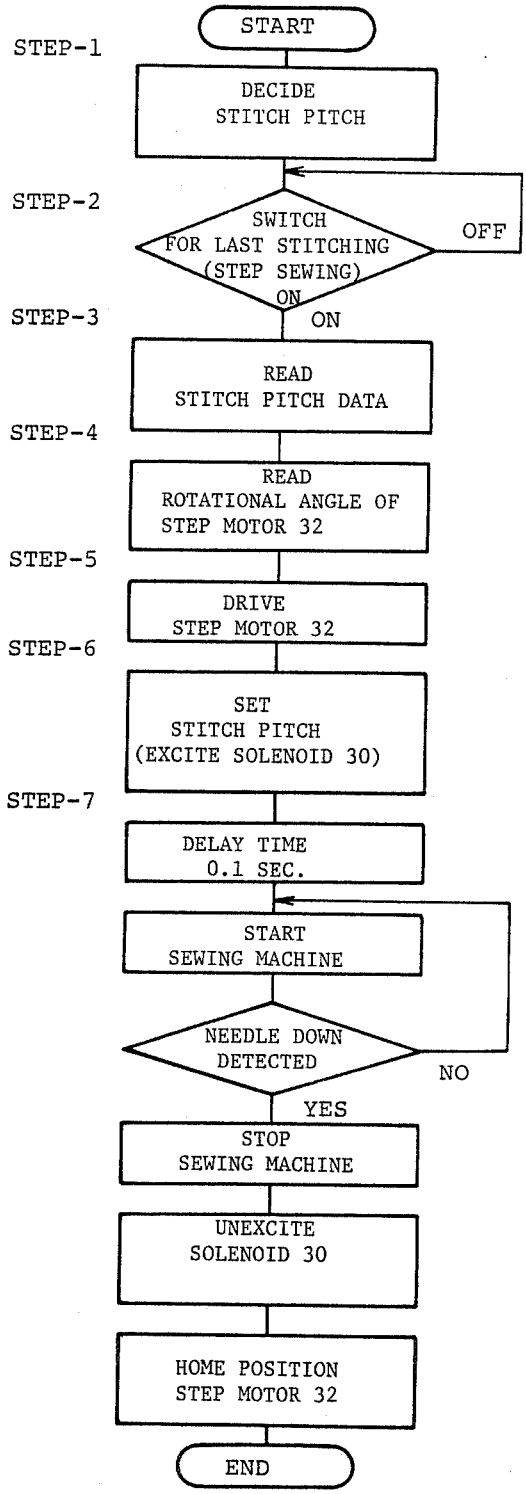
FIG. 6 is an operation flow chart according to the invention.

During a sewing operation, if the last stitch terminates at a position short of the predetermined position, the operator identifies the stitch pitch required for the last stitch to terminate at the predetermined position. The following steps then are performed:

Referring to FIG. 1, TABLE-1, and FIG. 6, the stitch pitch is first set at a digital switch 2. By way of example, the operator might select a stitch pitch of 0.6 mm (STEP 1). In such case the entry "LHHL" is set.

"Step sewing" switch 6 then is pushed (STEP 2).

CPU 3 reads the value of digital SWITCH 2, and stores the digitally coded signal in RAM 1 (STEP 3).

CPU 3 also reads the rotational angle of stepping motor 32 and stores it in RAM 1 (STEP 4).

CPU 3 then drives step motor 32 (STEP 5), and end 28*a* of the link arm 28 abuts against cam surface 31*a*. The action lever 27 is then rotated counterclockwise in cooperation with the motion of the link arm 28 causing pin 27*a* to push the rocker arm 23 counterclockwise. Accordingly, the adjusting shaft 15*d* fixed to the rock arm 23 rotates counterclockwise also. This rotation of adjusting shaft 15*d* causes the hinge pin 15*k* to move up and down via the arm 15*f* and the connecting rod 15*g*. Consequently the rocker arm 15*h* and the rocker 15*i* are moved.

Figure 3A:
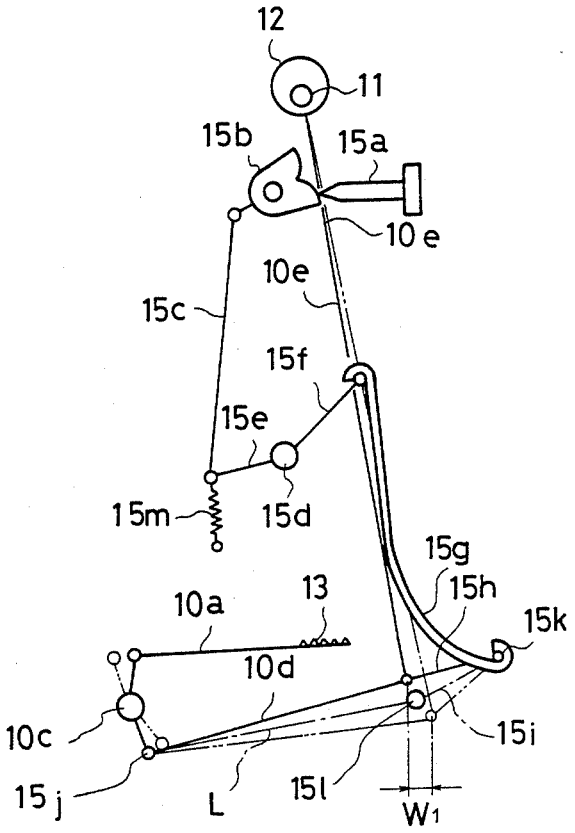
FIG. 3*a*–3*b* are function diagrams of the stitch pitch adjusting mechanism which illustrate how to adjust the stitch pitch.
Figure 3B:
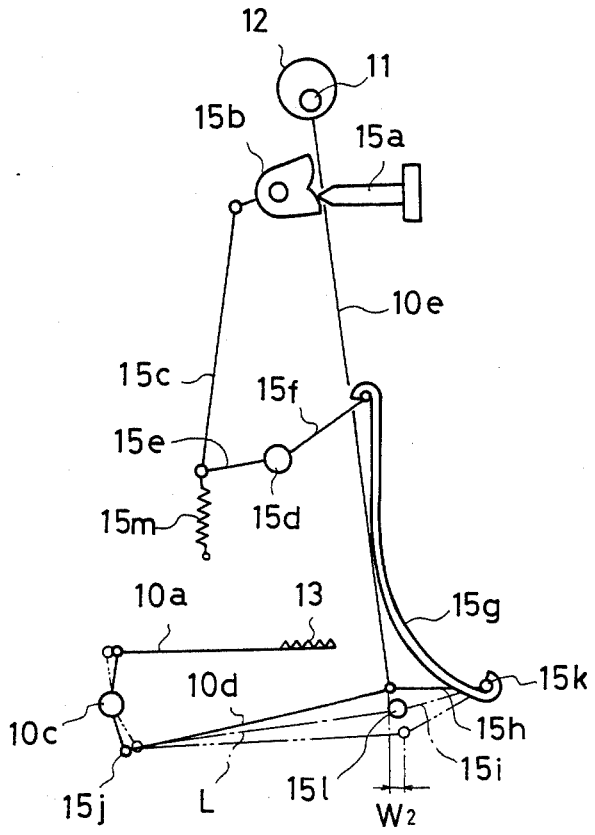

Thus, the relative position of the rock hinge pin 15*k* against line "L" changes, the horizontal component of the rocker 15*i* changes and the stitch pitch is set as per "$W_1$" in FIG. 3*a* and "$W_2$" in FIG. 3*b* (STEP 6).

The sewing machine then starts after 0.1 seconds time delay from the time that the stitch pitch is determined (STEP 7).

When the needle-down-detecting-signal is energized, the sewing machine stops and thus the last single-adjusting stitch is conducted. Then the solenoid 30 unexcites and the stepping motor 32 resumes a home position and the stitch pitch adjusting shaft 15*d* is released from rotational force of the action lever 27. The shaft 15*d* then is returned to its home position by the spring 15*m*. Thus the stitch pitch resumes the original pitch as adjusted by the adjusting screw 15*a*.

Whenever the step sewing switch 6 is pressed on, the above described steps repeat and the single stitching (step sewing) is conducted. As aforementioned, this invention is effective to conduct single stitching (step sewing) with the optional pitch.

As many apparently widely different embodiments of the invention may be made without departing the spirit and scope therein, it is to be understood that the invention is not limited to the specific embodiment thereof except as defined in the appended claims.

TABLE 1

STITCH PITCH VS. SWITCHING CONDITION

| A | B | C | D | STITCH PITCH (mm) |
|---|---|---|---|---|
| L | L | L | H | 0.1 |
| L | L | H | L | 0.2 |
| L | L | H | H | 0.3 |
| L | H | L | L | 0.4 |
| L | H | L | H | 0.5 |
| L | H | H | L | 0.6 |
| L | H | H | H | 0.7 |
| H | L | L | L | 0.8 |
| H | L | L | H | 0.9 |
| H | L | H | L | 1.0 |
| H | L | H | H | 1.1 |
| H | H | L | L | 1.2 |
| H | H | L | H | 1.3 |
| H | H | H | L | 1.4 |
| H | H | H | H | 1.5 |

H - High Level
L - Low Level

What is claimed is:

1. An apparatus for setting a last additional stitch, comprising:

operator controlled means for selecting the stitch pitch of said last additional stitch, means to store data representative of the pitch of said last additional stitch, said means including a memory device to store said representative data;

means to input stitch pitch;

means to read out said additional stitch pitch from said means to store data, said means to read out including a central processing unit and switching means for accessing said data stored in said memory device;

means to adjust said additional stitch pitch in compliance with data read out by said read out means;

means to feed the workpiece with said additional stitch pitch adjusted by said adjusting means; and means to step stitch a single additional stitching with said feeding means at said additional stitch pitch.

2. An apparatus for setting a last additional stitch with a stitching device in a workpiece at a stitch pitch comprising:

operator controlled means for selecting said additional stitch pitch;

means for adjusting a stitch device to set a stitch at said selected additional stitch pitch;

means for stepping a stitching device to set a single stitch at the selected additional stitch pitch;

means for storing said additional stitch pitch data including a memory device to store said data; and processing means for retrieving said additional stitch pitch data from the storing means based upon the selected additional stitch pitch wherein the retrieved data is output to the adjusting means, said processing means including a central processing unit for accessing said data from said memory device.

3. The apparatus of claim 2 wherein the selecting means is a digital switch having at least 4 bit resolution of stitch pitch.

* * * * *